US006250135B1

(12) United States Patent
Nelson et al.

(10) Patent No.: US 6,250,135 B1
(45) Date of Patent: Jun. 26, 2001

(54) APPARATUS FOR DETECTING A DEFECT IN CONTAINER END MANUFACTURE

(75) Inventors: Rick W. Nelson, Golden; Forrest Curtis; Harley S. Crabtree, both of Arvada; Craig L. Roberts, Golden, all of CO (US)

(73) Assignee: Coors Brewing Company, Golden, CO (US)

( * ) Notice: Subject to any disclaimer, the term of this patent is extended or adjusted under 35 U.S.C. 154(b) by 0 days.

(21) Appl. No.: 09/305,415

(22) Filed: May 5, 1999

(51) Int. Cl.[7] ..... G01M 3/00; G01N 3/08
(52) U.S. Cl. ..... 73/52; 73/834
(58) Field of Search ..... 73/826, 831, 834, 73/835, 838, 52

(56) References Cited

U.S. PATENT DOCUMENTS 5,505,099 * 4/1996 Tanaka ..... 73/865.9

OTHER PUBLICATIONS

Brochure by SPT Stolle Precision Tool Company entitled, "Precision by Craftsmen Serving Worldwide Can Manufacturing Markets", 7 pages, undated.

* cited by examiner

*Primary Examiner*—Benjamin R. Fuller
*Assistant Examiner*—Maurice Stevens
(74) *Attorney, Agent, or Firm*—William P. O'Meara; Jay K. Malkin; Klaas, Law, O'Meara & Malkin, P.C.

(57) ABSTRACT

Apparatus for detecting a defect during the formation of a container end having a stay-on-tab secured thereto, particularly when the defect is associated with a mis-located tab, in which a portion of the apparatus will be moved by the defect which movement is sensed and a signal is generated.

19 Claims, 1 Drawing Sheet

APPARATUS FOR DETECTING A DEFECT IN CONTAINER END MANUFACTURE

FIELD OF THE INVENTION

This invention relates generally to the manufacture of container ends having a pull tab and more particularly to the detection of a defect occurring during the manufacture of container ends.

BACKGROUND OF THE INVENTION

Apparatus for the manufacture of container ends having pull tabs secured thereon for opening the container end is illustrated in a brochure published by The Stolle Precision Tool Company which is incorporated herein by reference thereto. As illustrated in the brochure, the container end manufacture involves two distinct operations. In one operation, a plurality of container end blanks are positioned in openings in a conveyor which is moved in a stepping operation so that the container end blank is moved between upper and lower dies at different positions to have a particular operation performed thereon. As illustrated in the brochure, a container end blank is intermittently moved to different positions to have a rivet stud formed therein. After that the score lines and indentation lines are formed therein. At the next position, the pull tab is placed over the rivet stud which is then smashed to hold the pull tab onto the container end blank. As illustrated in the brochure, the pull tabs are formed in a separate series of operations and, after being fully formed are positioned with an opening therein in alignment with the rivet stud. As illustrated in the brochure, the pull tabs are formed using a continuous strip of metal that is intermittently moved through a plurality of stations. As the pull tabs are being formed, they remain attached to the continuous strip of metal by one or more carry strips. The brochure illustrates two spaced apart carry strips between the tail of the pull tab and the continuous strip of metal. In another type of apparatus for the manufacture of the pull tab, only one carry strip is used and is located between the nose of the pull tab and the continuous strip of metal. The purpose of the carry strip or strips is to ensure that the pull tabs move with the continuous strip of metal. When the pull tab is separated from the continuous strip of metal to be placed over the rivet stud, a projecting portion of the carry strip remains attached to the nose of the pull tab or projecting portions of the carry strips remain attached to the tail of the pull tab. In either case, it is necessary to wipe down the pull tab to remove these projecting portions so that they will not result in deleterious contact with the user of the container on which the container end is secured either in the opening or using of the container. Therefore, the next position in the formation of a container end with a pull tab secured thereon is known as the tab wipe down assembly. In this position an upper die is provided with a portion to fold the projecting portion or portions so that the portion or portions have substantially the same configuration as the adjacent portions of the nose or tail of the pull tab. The upper die is also provided with a pilot that enters the finger hole of the pull tab to prevent lateral movement of the pull tab during the operation of the wiping operation so that no undue force is placed on the rivet to cause damage thereto. In the apparatus illustrated in the brochure, the conveyor carrying the container blanks has three rows of openings and moves at the rate of speed so that more than six hundred cans per minute in each row are passed through the various positions. Therefore, it is desirable to detect any defect in the production of the container ends as soon as possible to avoid the waste of a considerable amount of metal. There are many different types of causes which result in defects associated with the container ends. As illustrated on the front page of the brochure there are a variety of container ends having a pull tab secured thereon.

BRIEF DESCRIPTION OF THE INVENTION

This invention provides apparatus for detecting a defect in the manufacture of container ends having a pull tab secured thereto wherein the defect prevents a portion of the detecting apparatus from reaching its lowermost position in relation to the lowermost position of an upper die in which it is located and is preferably located in the tab wipe down assembly of apparatus used in the production of a variety of container ends having a pull tab secured thereto as described above.

In a preferred embodiment of the invention, the detecting apparatus comprises a modification of the upper die used in the tab wipe down assembly. At this location, the lower die is stationary and the upper die moves in a longitudinal direction toward or away from the lower die. The detecting apparatus moves with the upper die and is mounted in the upper die for limited longitudinal movement in each direction relative thereto. In the preferred embodiment of the invention, the upper die for use with the detecting apparatus comprises three separable parts which are held together by conventional apparatus. Each of the first and second parts have a passageway extending therethrough and the third part has a passageway extending partially therethrough. The longitudinal axes of the passageways are in alignment and are parallel to the longitudinal axis of the upper die but off-set therefrom.

The detecting apparatus is mounted in the passageways for movement with the upper die and for longitudinal movement relative to the uppper die. At least portions of the detecting apparatus and at least portions of the passageways have transverse configurations to prevent relative rotational movement between the upper die and the detecting device. The lowermost portion of the detecting apparatus has a transverse configuration corresponding to but slightly smaller than the finger hole in the stay-on-tab so that in normal operation, the lowermost portion of the detecting apparatus will be in its lowermost position when the upper die is in its lowermost position. The detecting apparatus is resiliently urged into its lowermost position.

Sensing apparatus is mounted at a fixed location on the upper die for movement therewith. At least a portion of the sensing apparatus and at least a portion of the detecting apparatus are located so that the sensing apparatus will generate a signal when the detecting apparatus is not in its lowermost position when the upper die is in its lowermost position.

In the normal operation of the tab wipe down assembly, the lowermost portion of the detecting apparatus will enter the finger hole of the stay-on-tab as the upper die is moving toward its lowermost position. A portion of the tab wipe down assembly will contact a portion of the tab and apply a force thereto a portion of which extends in a lateral direction. However, lateral movement of the pull tab is prevented by contact of the portion of the stay-on-tab surrounding the finger hole and the portion of the detecting apparatus surrounding the lowermost portion. The resilient force acting on the detecting apparatus to urge it toward its lowermost position is of sufficient force to prevent any upward movement of the detecting device resulting from any upward force resulting from the force applied by the wipe down assembly. However, if the stay-on-tab is mis-located, the lowermost portion of the detecting apparatus will contact a portion of the mis-located tab surrounding the finger hole and the lowermost portion of the detecting apparatus will be move upwardly a distance from its lowermost position. Defects other than a mis-located pull tab can also result in upward movement of the detecting apparatus. The sensing apparatus will sense this upward movement and will generate a signal. The resilient force urging the detecting apparatus into its lowermost position is not of sufficient strength to prevent this upward movement of the detecting apparatus.

BRIEF DESCRIPTION OF THE DRAWINGS

Illustrative and presently preferred embodiments of the invention are illustrated in the drawing in which.

DETAILED DESCRIPTION OF THE INVENTION

Figure 1:
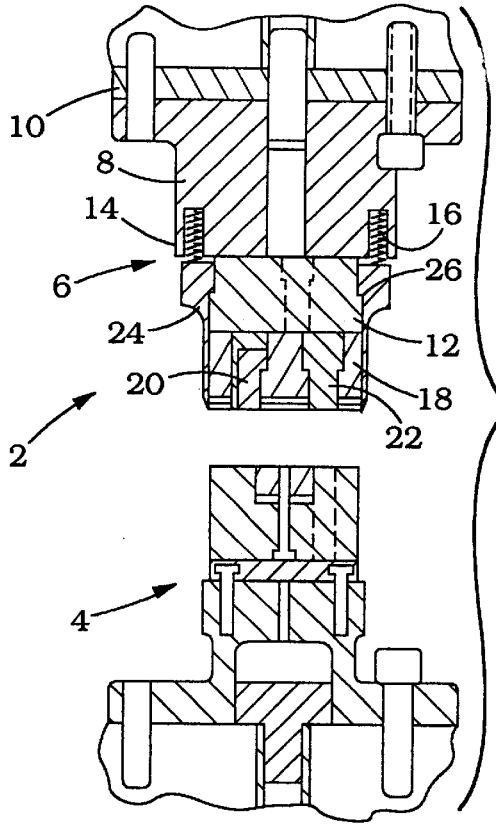
FIG. 1 (PRIOR ART)
FIG. 1 is an illustration of a prior art tab wipe down assembly.

In FIG. 1, there is illustrated a portion of apparatus for forming a container end with a stay-on-tab and is known as the tab wipe down assembly 2. The apparatus has a lower die 4 mounted at a fixed location and an upper die 6 mounted for vertical reciprocation along a longitudinal axis. The upper die 6 comprises a first part 8 secured to a ram 10 that is reciprocated by conventional means (not shown). A second part 12 is secured to the first part 8 for movement therewith. The first part 8 has an annular recess 14 formed therein and in which there is located a spring 16. A third part 18 is secured to the second part 12 for movement therewith. The third part 18 has a die 20 for wiping down the tab ear and another die 22 for holding down the finger hole portion of the stay-on-tab. A sleeve 24 surrounds the second and third parts 12 and 18 and is mounted for reciprocal movement over the second and third parts 12 and 18. The spring 16 acts on the sleeve 24 to normally urge the sleeve 24 against an annular abutment stop 26.

Figure 2:
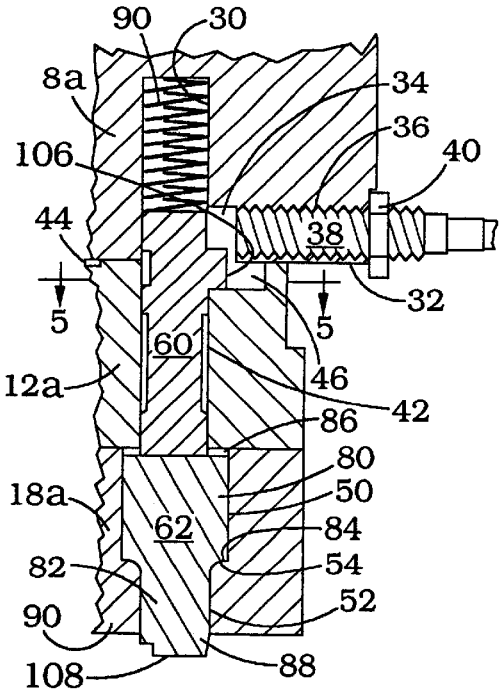
FIG. 2 is an elevational view with parts in section of a modification of a portion of the tab wipe down assembly of FIG. 1 in accordance with this invention.
Figure 6:
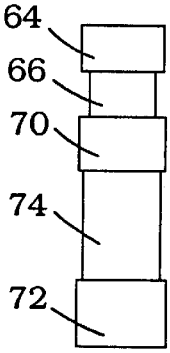
FIG. 6 is a front elevational view of the trigger of this invention.
Figure 7:
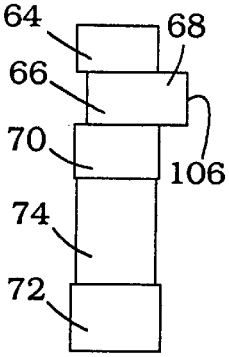
FIG. 7 is a side elevational view of FIG. 6.

In FIG. 2, there is illustrated a modification of the first, second and third parts, identified as 8*a*, 12*a* and 18*a*, in accordance with this invention.

Modified part 8*a* has a passageway 30 extending partially therethrough, a lower surface 32 and a slot 34 cut into the lower surface 32. A threaded passageway 36 extends from the outer surface of the modified part 8*a* and is in communication with the slot 34. In different types of wipe down assemblies, the radial location of the slot 34 and the threaded passageway 36 relative to the modified part 12*a*, may vary. As explained below, this will have no effect on the operation of the detecting apparatus of this invention. A proximity sensing apparatus 38 is threaded into the threaded passageway 36 and after being adjusted to its proper sensing location is secured in such sensing location by the nut 40.

Figure 5:
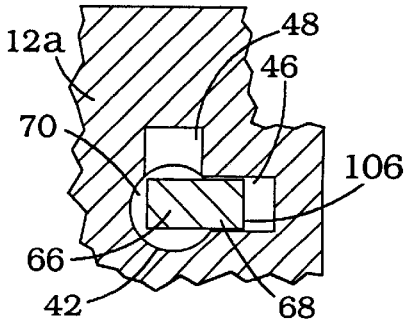
FIG. 5 is a partial cross-sectional view taken on the line 5—5 of FIG. 2.

Modified part 12*a* (illustrated in FIGS. 2 and 5) has a passageway 42 extending therethrough, an upper surface 44 and two slots 46 and 48 cut into the modified part 12*a* through the upper surface 44. As illustrated, the slots 46 and 48 extend at a substantially right angular relationship but can be of other angular relationships and in some instances may comprise only one slot. The slots 46 and 48 are to accommodate two known variations of the modified part 8*a*. In one modification, the slot 46 will be in alignment with the slot 34 and in another modification, the slot 48 will be in alignment with the slot 34. The passageways 30 and 42 preferably are of a cylindrical configuration but can be of other geometrical configurations.

Modified part 18*a* has two passageways 50 and 52 formed therein. The passageway 50 has a transverse cross-sectional area greater than the transverse cross-sectional area of the passageway 52 so as to form an abutment stop 54 therebetween. The passageway 50 preferably is of a cylindrical configuration but can be of other geometrical configurations. The passageway 52 preferably is of a configuration corresponding to but larger than the configuration of the finger hole in a tab as discussed below but can be of other geometrical configurations. The longitudinal axes of the passageways 30, 42, 50 and 52 preferably are in alignment.

The detecting apparatus of this application, as illustrated in FIGS. 2, and 4–7, preferably comprises a trigger 60 and a pilot 62 but may be of other constructions.

The trigger 60, illustrated in FIGS. 2 and 5–7, comprises a first portion 64 preferably having a cylindrical outer surface for longitudinal movement in the passageway 30; a second portion 66 preferably having a rectangular configuration and having a section 68 that projects into either of the slots 34 and 46 or the slots 34 and 48. The section 68 and the slots 34 and 46 or 34 and 48 have planar facing surfaces to guide the longitudinal movement of the trigger 60 and to prevent rotational movement of the trigger 60. Other structures may be used to prevent relative rotational movement between the trigger 60 and the upper die 2. The trigger 60 has third and fourth portions 70 and 72 each having a generally cylindrical outer surface for longitudinal movement in the passageway 42. A fifth portion 74, integral with the third and fourth portions 70 and 72, has a reduced outer cylindrical surface so as to reduce the frictional contact between the trigger 60 and the passageway 42.

Figure 4:
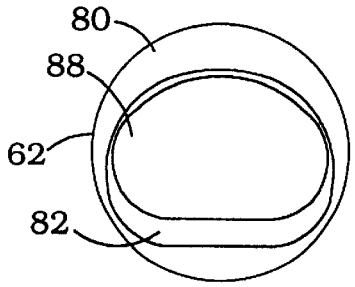
FIG. 4 is a bottom plan view of a portion of the detecting device of this invention.

The pilot 62, illustrated in FIGS. 2 and 4, comprises a first portion 80 preferably having a cylindrical outer surface for longitudinal movement in the passageway 50. As illustrated in FIG. 2, the longitudinal extent of the passageway 50 is greater than the longitudinal extent of the first portion 80 to permit the longitudinal movement of the pilot 62. The pilot 62 has a second portion 82 having a transverse cross-sectional configuration that corresponds to the transverse cross-sectional configuration of the passageway 52 that are of a geometrical configuration so as to prevent rotational movement of the pilot 62 and the upper die 2. Other structures, such as a key and a keyway, may be used to prevent relative rotational movement between the pilot 62 and the upper die 2. The transverse cross-sectional area of the first portion 80 is greater than the transverse cross-sectional area of the second portion 82 so as to provide an abutment stop 84. Also the transverse cross-sectional area of the passageway 50 is greater than the transverse cross-sectional area of the passageway 42 so as to provide an abutment stop 86. The pilot 62 has a third or lowermost portion 88 which in its lowermost position projects downwardly from the lower surface 90 of the modified third part 18*a*. The third or lowermost portion 88 has a transverse cross-sectional configuration that is slightly smaller than the transverse cross-sectional configuration of the finger hole of a tab (described below) so that, in the normal operation of the apparatus, the third or lowermost portion 88 will move through the finger hole of the tab. A resilient spring 90 is located in the passage way 30 and applies a resilient force on the trigger 60 and the pilot 62 to urge them downwardly until the abutment stops 54 and 84 are in a contacting relationship and the third or lowermost portion 88 is in its lowermost position.

Figure 3:
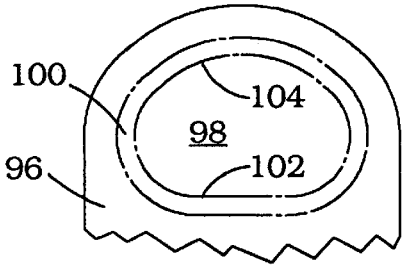
FIG. 3 is a top plan view of the finger hole portion of a tab.

In FIG. 3, there is illustrated a portion 96 of a pull tab for a container end having a finger hole 98 and a reinforcing portion 100 surrounding the finger hole 98. The finger hole 98 has a generally linearly extending portion 102 and a generally oval portion 104.

The operation of the apparatus is explaine d below in relation to a mis-located pull tab but as explained above and below other defects can result in preventing the pilot from reaching its lowermost position. The tab wipe down assembly of this invention will function in its conventional manner if the pull tab is not mis-located. That is, the die 20 will function to wipe down the carry strips on the pull tab and the third portion 88 will pass through the finger hole 98 to prevent lateral movement of the pull tab. The spring 90 has a sufficient strength to hold the pilot 62 at its lowermost position so that the abutment stops 54 and 84 are in a contacting relationship The proximity sensing apparatus 38 is adjusted, as described above, to sense the presence of a predetermined amount of the surface 106 of the projecting section 68. If a stay-on-tab is mis-located, the third portion 88 will not pass through the finger hole 98 and at least a portion of the surface 108 of the third portion 88 will contact at least a portion of the reinforcing portion 100 surrounding the finger hole 98 and this will cause the pilot 62 to move upwardly. The spring 90 does not have sufficient strength to prevent this upward movement of the pilot 62. The upward movement of the pilot 62 also moves the trigger 60 so that more of the surface 106 is exposed to and sensed by the proximity sensing apparatus 38 which generates a signal indicating a mis-located stay-on-tab. Also, if the stay-on-tab is not mis-located but some foreign object forces the upward movement of the pilot 62, the trigger 60 will also be moved and the proximity sensing apparatus 38 will generate a signal. The detecting apparatus of this invention can be used to detect defects in the production of any of the container ends having a pull tab secured thereto as illustrated in the Stolle brochure. These defects can result from a mis-located pull tab, a malformed rivet, double container end blanks, scrap in the tab die, scrap in the inserter, dirty vacuum filters, ends below the transfer belt or any other defects that prevents the pilot from reaching its lowermost position.

It is contemplated that the inventive concepts herein described may be variously otherwise embodied and it is intended that the appended claims be constructed to include alternative embodiments of the invention except insofar as limited by the prior art.

What is claimed:

1. Apparatus for detecting a defect during a formation of a container end having a pull tab secured thereto and wherein the pull tab has a finger hole formed therein and wherein the apparatus includes a lower die on which the container end is supported comprising:

an upper die having a longitudinal axis and mounted for longitudinal movement toward or away from said lower die;

detecting apparatus having a longitudinal axis and mounted in said upper die for movement therewith and for longitudinal movement relative thereto;

said detecting apparatus having a lowermost portion having a transverse configuration corresponding to but slightly smaller than a transverse configuration of said finger hole;

said lowermost portion of said detecting apparatus being located to enter into said finger hole when said upper die is in a lowermost position adjacent to said lower die;

said lowermost portion of said detecting apparatus normally being in a lowermost position when said upper die is in said lowermost position;

sensing apparatus being entirely mounted at a fixed location on said upper die for movement therewith;

said detecting apparatus having at least a portion thereof located on said upper die to be sensed by said sensing apparatus;

said sensing apparatus having at least a portion thereof located on said upper die to sense a location of said at least a portion of said detecting apparatus; and said sensing apparatus generating a signal when said upper die is at said lowermost position and said detecting apparatus has been moved a distance from said lowermost position thereof.

2. Apparatus as in claim 1 and further comprising:

abutment stops in said upper die and on said detecting apparatus for limiting said relative movement of said detecting apparatus toward said lower die so that said detecting apparatus is in said lowermost position when in contact with said abutment stops.

3. Apparatus as in claim 2 and further comprising:

resilient apparatus between said upper die and said detecting apparatus for urging said detecting apparatus against said abutment stops.

4. Apparatus as in claim 3 and further comprising:

at least a first surface in said upper die and at least a second surface on said detecting apparatus for preventing rotational movement between said upper die and said detecting apparatus.

5. Apparatus as in claim 1 and further comprising:

resilient apparatus between said upper die and said detecting apparatus for urging said detecting apparatus into said lowermost position.

6. Apparatus as in claim 5 wherein:

said resilient apparatus having sufficient strength to permit the normal operation of said detecting apparatus but not of sufficient strength to prevent movement of said detecting apparatus away from said lowermost position when a sufficient force is applied thereto.

7. Apparatus as in claim 5 and further comprising:

first abutment stops in said upper die and on said detecting apparatus for limiting said relative movement of said detecting apparatus toward said lower die and so that said detecting apparatus is normally in said lowermost position;

second abutment stops in said upper die and on said detecting apparatus for limiting said movement of said detecting apparatus away from said lowermost position.

8. Apparatus as in claim 6 and further comprising:

said detecting apparatus having an upper portion and a lower portion;

at least a first guide surface in said upper die and at least a second guide surface on said upper portion for preventing rotational movement between said upper die and said upper portion.

9. Apparatus as in claim 8 and further comprising:

said upper die having a transversely extending opening formed therein; and said sensing apparatus being located in said transversely extending opening.

10. Apparatus as in claim 9 wherein:

said at least a first guide surface comprises a recess formed in said upper die in communication with said opening;

said recess having opposite guide surfaces extending in a direction parallel to said longitudinal axis of said upper die;

said at least a second guide surface comprises a projection extending in a transverse direction from said upper portion;

said projection having opposite guide surfaces extending in a direction parallel to said longitudinal axis of said detecting apparatus; and said projection being located in said recess and having a surface facing said sensing apparatus so that said sensing apparatus will sense any longitudinal movement of said projection.

11. Apparatus as in claim 10 and further comprising:

said upper portion being located in one portion of said upper die and said lower portion being located in another portion of said upper die; and said lower portion and said another portion having transverse cross-sectional configurations of a geometrical configuration to prevent relative rotational movement therebetween.

12. Apparatus as in claim 1 wherein said upper die comprises:

a plurality of separate parts joined together to have a longitudinal axis;

each of said plurality of parts having a passageway extending in a longitudinal direction;

said passageways being in alignment and offset from said longitudinal axis of said upper die; and said detecting apparatus comprises:

a lower portion mounted in one of said plurality of separate parts for longitudinal movement therewith and relative thereto;

said lowermost portion being a portion of said lower portion;

an upper portion having portions thereof mounted in said plurality of separate parts for longitudinal movement therewith and relative to said plurality of parts; and resilient apparatus for applying a force on said lower and upper portions to urge said lowermost portion of said detecting apparatus into said lowermost position.

13. Apparatus as in claim 12 wherein:

said upper die having at least one transversely extending opening formed therein at a fixed location;

said sensing apparatus being located in said opening at least one transversely extending opening and located so that said sensing apparatus senses the movement of said detecting apparatus from said lowermost position.

14. Apparatus as in claim 13 and further comprising:

a portion of said upper portion projecting outwardly in a transverse direction therefrom;

said portion having opposite first guide surfaces extending in a direction parallel to said longitudinal axis of said upper die;

said upper die having a recess formed therein;

said recess having opposite second guide surfaces extending in a direction parallel to said longitudinal axis of said upper die; and said first and second guide surfaces limiting the movement of said upper portion to longitudinal movement so that said portion of said upper portion may be sensed by said sensing apparatus.

15. Apparatus as in claim 12 wherein:

said resilient apparatus having sufficient strength to permit the normal operation of said detecting apparatus but not of sufficient strength to prevent movement of said detecting apparatus away from its lowermost position when a sufficient force is applied thereto.

16. Apparatus as in claim 1 wherein:

said distance moved by said detecting apparatus from said lowermost position is in a direction toward said sensing apparatus.

17. A method as in claim 15 and further comprising:

providing abutment stops for locating said pilot in said lowermost position;

resiliently urging said pilot against said abutment stops but permitting said movement of said pilot by said mis-located tab.

18. A method for detecting a mis-located tab on container end having a pull tab secured thereon and having a finger hole using apparatus having an upper die and a lower die for performing a tab wipe down wherein the upper and lower dies have longitudinal axes and the upper die moves in longitudinal directions toward and away from the lower die and wherein sensing apparatus is fixedly mounted in the upper die for movement therewith and a pilot is normally mounted in the upper die for movement therewith and relative thereto so that a lowermost portion thereof is located to normally enter the finger hole of the pull tab when the upper die is at said lowermost position to prevent lateral movement of the pull tab comprising:

moving said upper die in longitudinal directions between an upper position and a lowermost position;

mounting said pilot in said upper die for longitudinal movement with said upper die to a lowermost position and relative to said upper die toward an upper position spaced from said lowermost position;

mounting all of said sensing apparatus at a fixed location in said upper die for longitudinal movement with said upper die;

moving said pilot from said lowermost position toward said upper position spaced from said lowermost position by contact between said pilot and a mis-located tab; and sensing said movement of said pilot from said lowermost position and generating a signal in response thereto.

19. A method for detecting a defect during the formation of a container end having a pull tab secured thereon and having a finger hole using apparatus having an upper die and a lower die having longitudinal axes extending in the same direction and wherein the upper die moves in longitudinal directions between a lowermost position adjacent to the lower die and an uppermost position spaced away from the lower die and wherein sensing apparatus is fixedly mounted in the upper die for movement therewith and wherein detecting apparatus is mounted in the upper die for movement therewith and longitudinal movement relative thereto comprising:

moving said upper die in longitudinal directions between an upper position and a lowermost position;

mounting all of said sensing apparatus at a fixed location in said upper die for longitudinal movement therewith;

mounting said detecting apparatus in said upper die for longitudinal movement therewith to a lowermost position corresponding to said lowermost position of said upper die and longitudinal movement relative to said upper die toward an upper position spaced from said lowermost position in a direction toward said sensing apparatus;

applying a resilient force on said detecting apparatus to urge said detecting apparatus into said lowermost position;

moving said detecting apparatus from said lowermost position toward said upper position spaced from said lowermost position by contact between said detecting apparatus and a defect associated with said container end;

sensing said movement of said detecting apparatus toward said upper position spaced from said lowermost position and generating a signal in response thereto.

* * * * *